US005730057A

United States Patent [19]

Loftus et al.

[11] Patent Number: 5,730,057

[45] Date of Patent: Mar. 24, 1998

[54] CLEANING ASSEMBLY FOR CLEANING PRINTING UNITS OF A DIRECT IMAGING ROTARY PRINTING PRESS

[75] Inventors: Geoffrey Loftus, Marietta, Ga.; Andreas Detmers, Mauer, Germany

[73] Assignee: Heidelberger Druckmaschinen AG, Heidelberg, Germany

[21] Appl. No.: 643,598

[22] Filed: May 6, 1996

[30] Foreign Application Priority Data

May 4, 1995 [DE] Germany ..... 195 16 068.1

[51] Int. Cl.[6] ..... B41F 35/00; B41F 35/02; B41L 41/02

[52] U.S. Cl. ..... 101/425

[58] Field of Search ..... 101/425

[56] References Cited

U.S. PATENT DOCUMENTS

| | | | |
|---|---|---|---|
| 1,574,708 | 2/1926 | Smothers | 101/425 |
| 1,703,015 | 2/1929 | Ratignier | 101/425 |
| 2,752,271 | 6/1956 | Walkup et al. | 101/425 |
| 3,049,997 | 8/1962 | Grembecki et al. | 101/425 |
| 3,309,993 | 3/1967 | Grembecki et al. | 101/425 |
| 4,667,597 | 5/1987 | Wright et al. | 101/425 |
| 5,438,923 | 8/1995 | Schoeps | 101/425 |

FOREIGN PATENT DOCUMENTS

| | | | |
|---|---|---|---|
| 0 328 369 A1 | 8/1989 | European Pat. Off. . | |
| 0 461 898 A1 | 12/1991 | European Pat. Off. . | |
| 18224 | of 1912 | United Kingdom | 101/425 |
| 1 540 641 | 2/1979 | United Kingdom . | |

OTHER PUBLICATIONS

Hewitt, Robert E. and Charles J. Hull. "Photoreceptor Cleaning" Xerox Disclosure Journal, vol. 3, No. 5, Sep./Oct. 1978.

*Primary Examiner*—Edgar S. Burr
*Assistant Examiner*—Leslie Grohusky
*Attorney, Agent, or Firm*—Herbert L. Lerner; Laurence A. Greenberg

[57] ABSTRACT

Wash-up assembly for washing printing units and adjacent regions in a rotary printing press having printing units including a printing-form cylinder and a blanket cylinder cooperating with an impression cylinder, and a wash-up device assigned to each printing unit for washing the outer cylindrical surface of at least one of the respective printing-form cylinder and the respective blanket cylinder thereof, further includes a sucking unit assigned to a respective printing unit in a wedge-shaped nip region between the respective printing-form cylinder and the respective blanket cylinder thereof, the sucking unit having at least one opening directed substantially towards respective outer cylindrical surfaces of the respective printing form and blanket cylinders.

5 Claims, 3 Drawing Sheets

CLEANING ASSEMBLY FOR CLEANING PRINTING UNITS OF A DIRECT IMAGING ROTARY PRINTING PRESS

BACKGROUND OF THE INVENTION

Field of the Invention

The invention relates to a wash-up assembly for washing printing units of a rotary printing press.

Rotary printing presses, in general, as well as rotary printing presses wherein a printing form is directly imaged in the printing press encounter the problem that paper dust and dried ink residues have to be removed from the inking unit or printing unit in order to avoid impairment of the print quality. Manual washing is complicated and time-consuming; with regard to locations in the printing unit which have limited accessibility, the washing results are not satisfactory.

In comparison with the washing of printing units of conventional printing presses, printing presses with directly imageable printing forms require that, in particular, silicone residues as well as other particles, such as mentioned hereinbefore, be removed from printing and inking units. Mechanical devices such as brushes or electrostatic elements have proven inadequate to remove the aforementioned residues.

SUMMARY OF THE INVENTION

It is accordingly an object of the invention to provide a wash-up assembly for washing printing units, as well as adjacent regions, of a rotary printing press with which, without any manual interference, residues may be removed to the greatest possible extent.

With the foregoing and other objects in view, there is provided in accordance with the invention, a wash-up assembly for washing printing units and adjacent regions in a rotary printing press having printing units including a printing-form cylinder and a blanket cylinder cooperating with an impression cylinder, and a wash-up device assigned to each printing unit for washing the outer cylindrical surface of at least one of the respective printing-form cylinder and the respective blanket cylinder thereof, comprising a sucking unit assigned to a respective printing unit in a wedge-shaped nip region between the respective printing-form cylinder and the respective blanket cylinder thereof, the sucking unit having at least one opening directed substantially towards respective outer cylindrical surfaces of the respective printing form and blanket cylinders.

In accordance with another feature of the invention, the sucking unit is assigned to the wash-up device of the respective printing unit.

In accordance with a further feature of the invention, the sucking unit includes rotating brushes.

In accordance with an added feature of the invention, the sucking unit includes rubber-covered roller bodies.

In accordance with a concomitant feature of the invention, the sucking unit is connected to a controllable vacuum source.

The sucking or suction unit is connected to a controllable vacuum source for, thereby, influencing the suction force and controlling the suction output of the sucking unit. Because the openings or inlets of the sucking unit face generally towards the outer cylindrical surfaces of both printing-unit cylinders, residues can be removed from the outer cylindrical surfaces of both cylinders and from the adjacent wedge-shaped nip region therebetween.

Other features which are considered as characteristic for the invention are set forth in the appended claims.

Although the invention is illustrated and described herein as embodied in a wash-up device for washing printing units of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1:
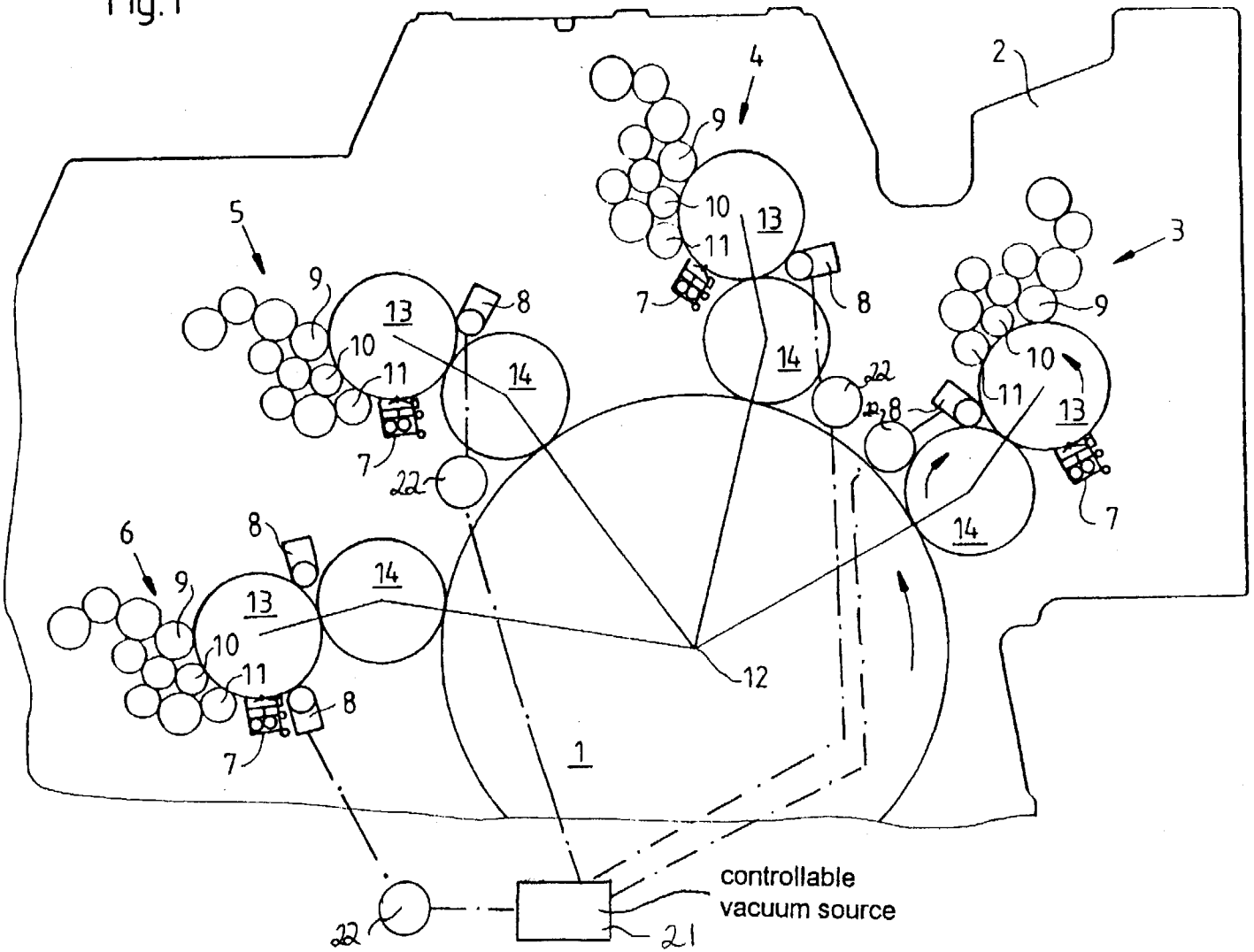
FIG. 1 is a fragmentary, diagrammatic side elevational view of a printing press operating in accordance with the so-called satellite principle.

Referring now to the drawings and, first, particularly to FIG. 1 thereof, there is shown therein in a side elevational view, a rotary printing press constructed, for example, in accordance with the satellite principle.

An impression cylinder 1 having a circumferential outer cylindrical surface whereon a plurality of printing sheets can be accepted at one time is journalled in side walls 2. Printing units 3, 4, 5, and 6 are assigned in a satellite-type manner around the outer cylindrical surface of the impression cylinder 1 and print the sheets suitably held thereon. The impression cylinder 1 rotates about its axis 12.

Each of the printing units 3, 4, 5 and 6 includes a printing-form cylinder 13 and a blanket cylinder 14 cooperating with one another. Ink transport to the printing-form cylinder 13 is effected via a respective inking unit, of which form rollers 9, 10 and 11 apply the ink to the printing form 25 on the respective printing-form cylinder 13. A respective wash-up device 7 is assigned to the outer cylindrical surface of the respective printing-form cylinder 13. Furthermore, a suction unit 8, which has been moved as close as possible to the outer cylindrical surfaces of the cooperating-printing-unit cylinders 13 and 14 is assigned to the respective wedge-shaped nip region therebetween in each printing unit 3, 4, 5 and 6. In the printing unit 6, which is fourth in line in the direction of rotation of the impression cylinder 1 as represented by the associated arrow, the wash-up device 7 is directly followed by the suction or sucking unit 8 so that loosened ink residues or other particles such as silicone particles may be removed from the printing unit immediately after they have been loosened. Moreover, in this fourth printing unit 6, a second suction or sucking unit 8 is provided in the wedge-shaped nip region between and above the cooperating printing-unit cylinders 13 and 14.

Figure 2:
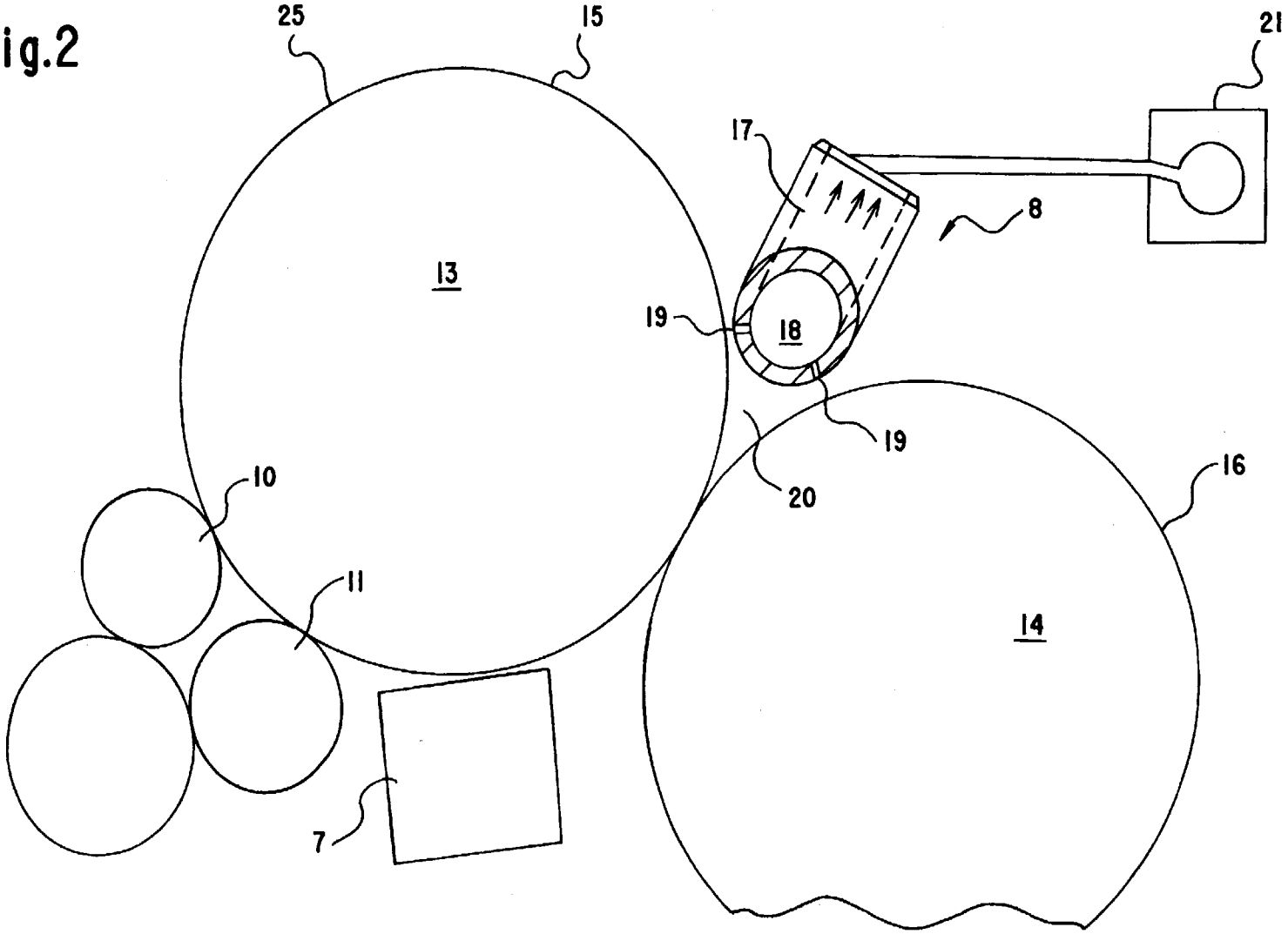
FIG. 2 is an enlarged fragmentary view of FIG. 1, showing in greater detail a wedge-shaped nip region between two printing-unit cylinders.

FIG. 2 is an enlarged view of the printing-form cylinder 13 and the blanket cylinder 14 of one of the printing units 4 to 6, namely the exemplary printing unit 5, of FIG. 1, and shows details of the wedge-shaped nip region between the two printing-unit cylinders 13 and 14 thereof. A diagrammatically illustrated wash-up device 7 is provided below the printing-form cylinder 13. Furthermore, form rollers 9, 10 and 11 provided for the ink transport or ink feeding are in engagement with the outer cylindrical surface 15 of the printing-form cylinder 13. A suction or sucking unit 8 is disposed in the wedge-shaped nip region 20 of the two cooperating printing-unit cylinders 13 and 14 and is formed as a suction connection or union 17 having a tubular hollow body formed with openings 19. The openings 19 formed in the tubular hollow body 17 are directed, respectively, for the most part towards the outer cylindrical surfaces 15 and 16 of the two cooperating printing-unit cylinders 13 and 14. If the suction union 17 is connected to a non-illustrated controllable vacuum source, the hollow body 18 and the outlets 19 are supplied with vacuum which removes from the wedge-shaped nip region 20, for example, all silicone, paper, dust and other dried residues, after they have been loosened by the wash-up device 7. In a manner not set forth in this embodiment of FIG. 2, but shown with regard to the printing unit 6 of FIG. 1, the suction or sucking unit 8 may also be provided directly adjacent to the wash-up device 7 so that, immediately after the outer cylindrical surfaces 13 and 14 have passed the wash-up device 7, loosened ink residues and silicone particles may be removed directly from the outer cylindrical surface 15 of the printing-form cylinder 13.

In a further construction in accordance with the invention, it is conceivable to connect, for example, all of the suction or sucking units 8 disposed at the printing-units 3, 4, 5, and 6 in a satellite-type manner to a single vacuum source 21, and to provide devices 22 which ensure measurements of the vacuum which are controllable individually for each printing unit by means of the respective assigned suction or sucking unit 8.

Figure 3:
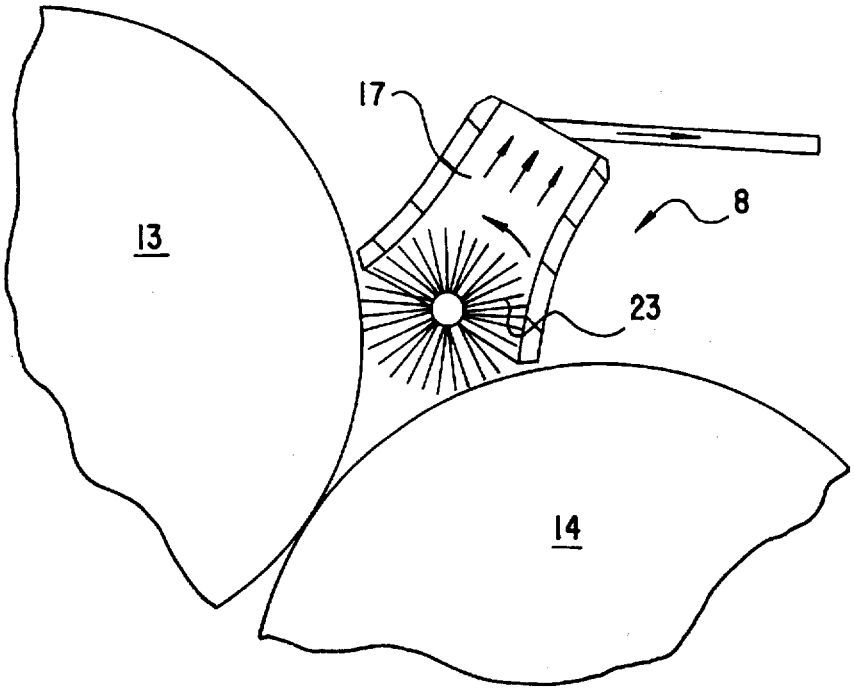
FIG. 3 is an enlarged fragmentary view of FIG. 1, showing a set of rotating brushes.
Figure 4:
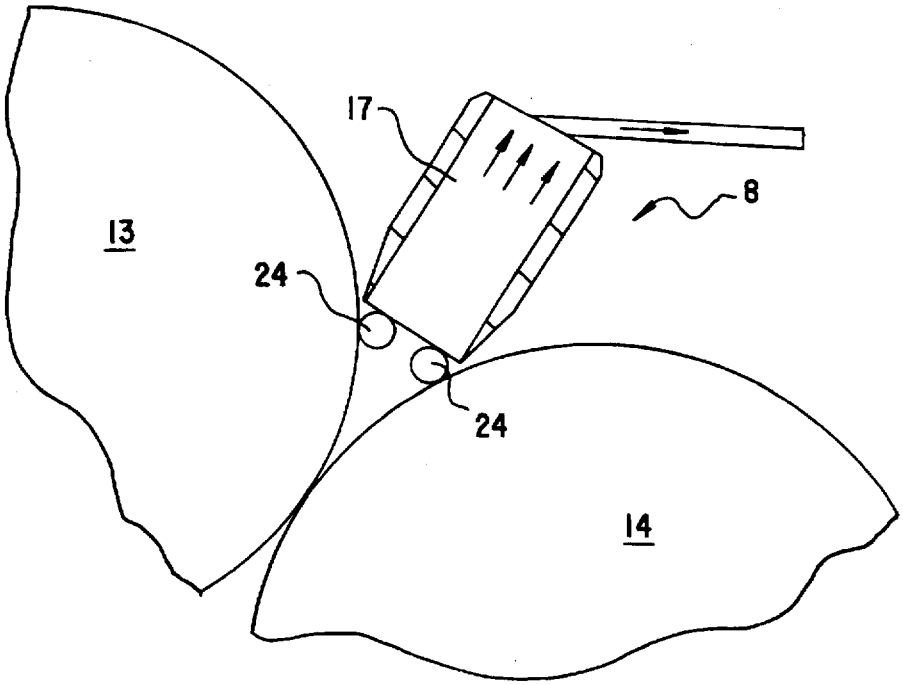
FIG. 4 is an enlarged fragmentary view of FIG. 1, showing a set of rubber-covered roller bodies.

Furthermore, the suction unit 8 may be of the conventional type which includes rotating brushes 23 and/or rubber-covered roller bodies 24. FIG. 3 shows the rotating brushes 23 housed in the suction unit 8. The rotating brushes 23 contact the two printing unit cylinder 13 and 14. FIG. 4 shows the rubber-covered roller bodies engaging the two printing unit cylinders 13 and 14.

We claim:

1. Printing units for a direct imaging rotary printing press, each of the printing units comprising:

a printing unit body having sidewalls;

a printing-form cylinder having an outer cylindrical surface disposed on said side walls;

a directly imageable printing form having a surface disposed on said outer cylindrical surface of said printing-form cylinder;

a blanket cylinder having an outer cylindrical surface cooperating with an impression cylinder, said blanket cylinder disposed on said side walls;

a cleaning assembly having a wash-up device for washing said outer cylindrical surface of said printing-form cylinder and said blanket cylinder after a direct imaging of said printing form; and said cleaning assembly having a sucking unit disposed in a wedge-shaped nip region between said printing-form cylinder and said blanket cylinder, said sucking unit having at least one opening directed substantially towards said outer cylindrical surface of said printing form cylinder and said outer cylindrical surface of said blanket cylinder for the removal of erased silicon particles.

2. The printing unit according to claim 1, wherein said sucking unit is one of a plurality of sucking units and said wash-up device cooperates with at least one of said sucking units.

3. The printing unit according to claim 1, wherein said sucking unit includes rotating brushes.

4. The printing unit according to claim 1, wherein said sucking unit includes rubber-covered roller bodies.

5. The printing unit according to claim 1, wherein said sucking unit is connected to a controllable vacuum source.

* * * * *